United States Patent [19]

Mohr

[11] 3,950,812

[45] Apr. 20, 1976

[54] PORTABLE WIPING MACHINE FOR WET SURFACES

[76] Inventor: Harold R. Mohr, 3489 Saddle Drive, Hayward, Calif. 94541

[22] Filed: Nov. 22, 1974

[21] Appl. No.: 526,318

[52] U.S. Cl. ..... 15/98; 15/52

[51] Int. Cl.[2] ..... A47L 11/292; E01H 1/00

[58] Field of Search ..... 15/116 A, 119 R, 119 A, 15/52, 98, 99; 401/13

[56] References Cited

UNITED STATES PATENTS

| | | | |
|---|---|---|---|
| 530,689 | 12/1894 | Hitchcock | 15/52 |
| 550,971 | 12/1895 | Hoffheins | 15/52 |
| 2,136,324 | 11/1938 | Simon | 15/52 |
| 3,079,620 | 3/1963 | Hunter | 15/119 A |

FOREIGN PATENTS OR APPLICATIONS

| | | | |
|---|---|---|---|
| 459,281 | 9/1968 | Switzerland | 15/98 |
| 942,338 | 11/1963 | United Kingdom | 15/98 |
| 1,172,559 | 12/1969 | United Kingdom | 15/119 A |
| 543,513 | 7/1957 | Canada | 15/98 |

*Primary Examiner*—Daniel Blum
*Attorney, Agent, or Firm*—William R. Piper

[57] ABSTRACT

A portable wiping machine for removing water from a wet surface which may be manually moved over the surface and it includes a large drum whose cylindrical surface is perforated and covered with water absorbing material, such as a sponge. The sponge is compressed by its rolling contact over the surface and the expansion of the sponge portion as it leaves the surface will absorb the water therefrom. A sponge compressing roller is yieldingly held in contact with the top of the drum and a water receiving tray is fixedly mounted within the drum interior in a position to catch water squeezed from the sponge. A water retaining tank is supported by the machine and receives water from the tray. The tank can be emptied of water as desired.

2 Claims, 7 Drawing Figures

PORTABLE WIPING MACHINE FOR WET SURFACES

SUMMARY OF THE INVENTION

An object of my invention is to provide a manually manuverable portable wiping machine for removing water from a wet surface, such as a tennis court. The machine rotatably carries a large drum, whose cylindrical surface is perforated and covered with a layer of sponge that is progressively squeezed and expanded for sucking up any water from the wet surface over which the drum travels. A spring biased roller is yieldingly held against the upper portion of the drum and squeezes out any water from the sponge layer that passes under the roller. This water is forced through the perforated cylindrical drum surface and is received in a tray that in turn has conduits connecting it with a tank for transferring the water to the tank. The tank is supported by wheels that can travel over the wet surface and a frame is pivotally supported by the tank and in turn has the drum rotatably connected thereto so that an operator can grasp a handle on the frame and move the drum over the wet surface for removing water therefrom. Also, the operator can press downwardly on the handle for causing the frame to lift the drum above the surface and permit him to turn the machine within a short radius because certain of the tank supporting wheels are caster wheels and will swing about their vertical axes during this turning movement.

DESCRIPTION OF THE PREFERRED EMBODIMENT

Figure 1:
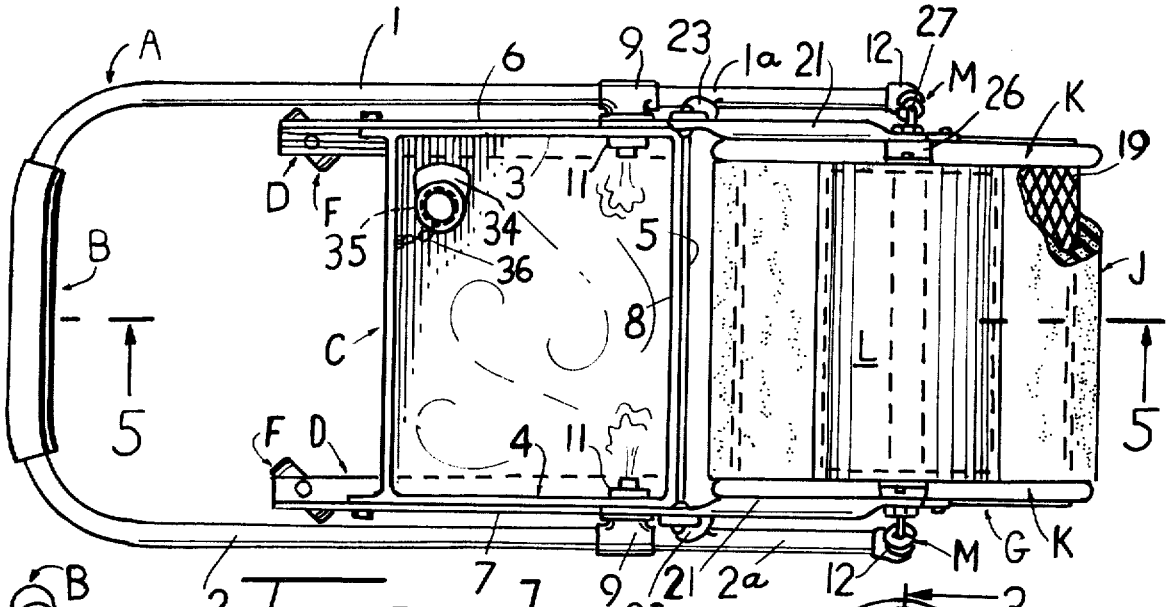
FIG. 1 is a top plan view of the device with a portion of the sponge layer on the drum being broken away to show that the cylindrical portion of the drum is perforated as for example the cylinder can be made of expanded metal.
Figure 2:
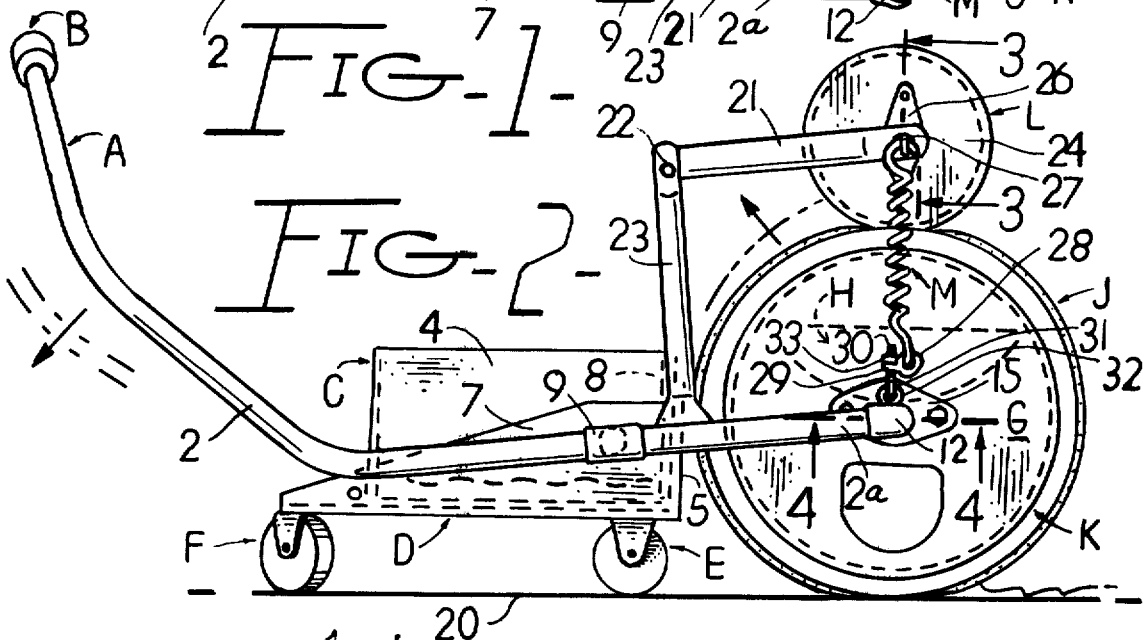
FIG. 2 is a side elevation of FIG. 1.

In carrying out my invention I provide a U-shaped tubular frame A, shown in top plan view in FIG. 1 and in side elevation in FIG. 2. This frame has a hand grip portion B and side members 1 and 2. It will be noted from FIGS. 1, 2, 5, 6 and 7 that the side members 1 and 2 of the U-shaped frame A are pivoted to opposite side walls 3 and 4, respectively, of a water receiving tank C. Before describing the pivotal support for the hollow U-shaped frame A in detail, it is best to first set forth how the water receiving tank is supported for movement over a surface, such as a tennis court.

Figure 5:
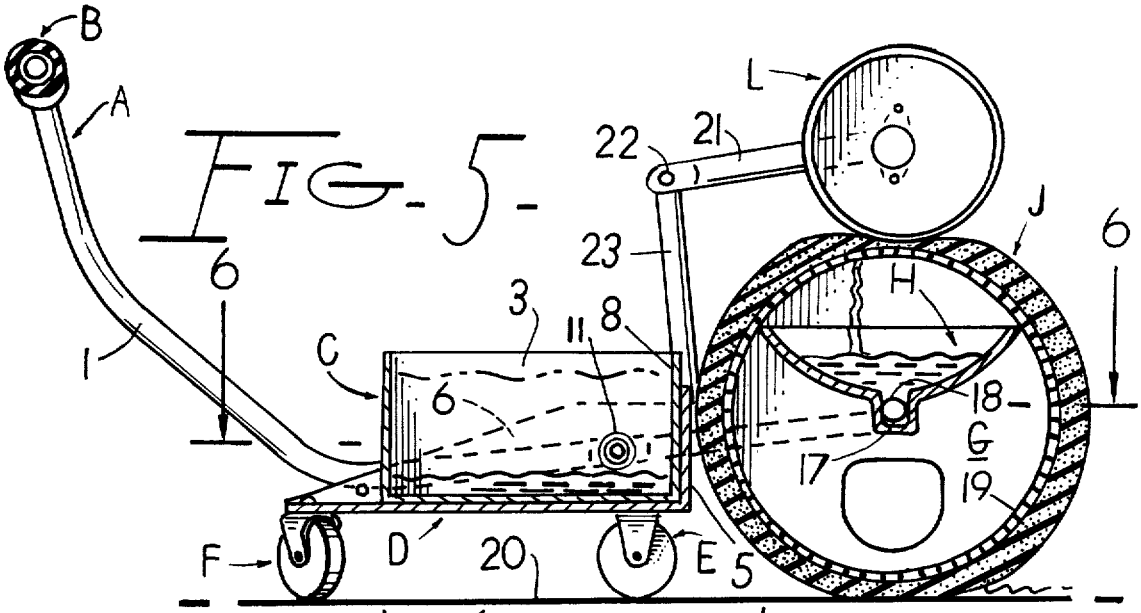
FIG. 5 is a longitudinal section through the machine and is taken along the line 5—5 of FIG. 1.
Figure 6:
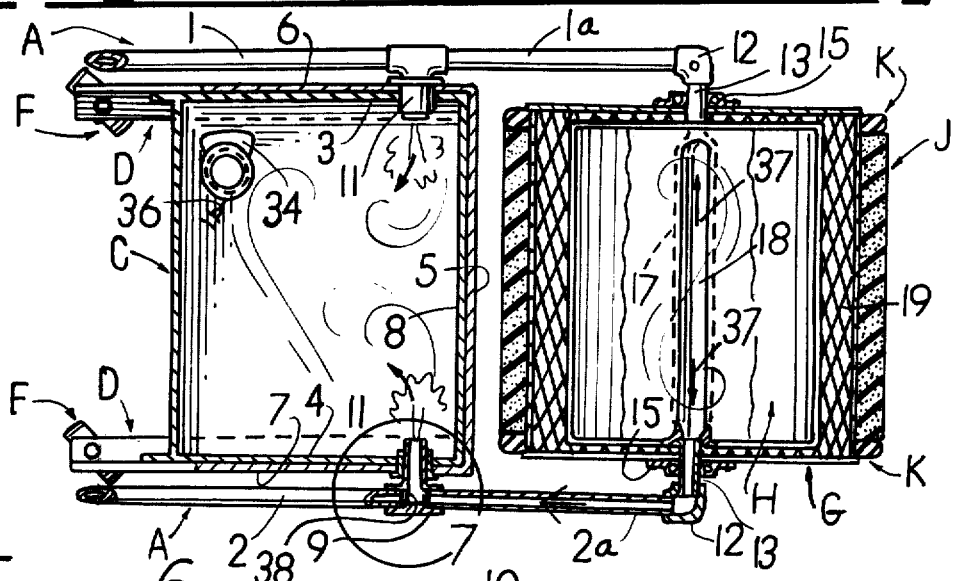
FIG. 6 is a horizontal section taken through the machine and is taken substantially along the line 6—6 of FIG. 5.

Referring to FIGS. 5 and 6, it will be noted that the water receiving tank C is mounted in a carriage D that in turn has a pair of front wheels E and a rear pair of caster wheels F mounted on the bottom of the carriage. The carriage D has a front wall 5 and side walls 6 and 7. The water receiving tank C is mounted in the carriage D so that the front wall 8 of the tank will abut the front wall 5 of the carriage and the side walls 3 and 4 of the tank will abut the opposite side walls 6 and 7, respectively, of the carriage.

Figure 7:
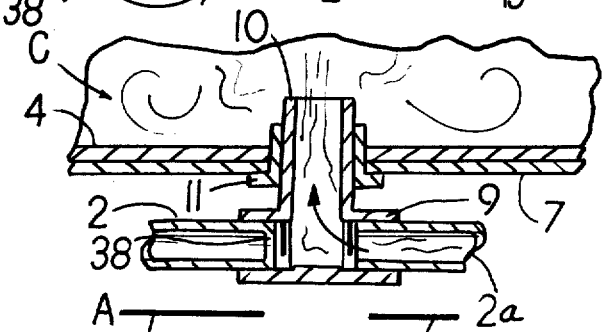
FIG. 7 is an enlarged horizontal section of the circled portion 7 in FIG. 6 and illustrates how the frame is pivotally mounted at the side of the tank and how the frame members are hollow and communicate with a hollow "T" that in turn is rotatably received in a bearing mounted in a side wall of the tank so that water can flow from the fixed tray within the drum and pass along the hollow frame members and into the tank.

Now, with reference as to how the tubular side members 1 and 2 of the U-shaped tubular frame A are pivotally mounted in the sides 3 and 4, respectively, the enlarged detail section of FIG. 7 illustrates this for the side member 2 of the frame A, and since the side 1 of the frame A is mounted in exactly the same manner, a description of the side 2 will suffice for both. The tubular side 2 of the frame A is connected to a hollow T, shown in section at 9. The stem portion 10 of the hollow T is rockably received in a bushing 11, the latter being mounted in both the side wall 7 of the carriage D and the side wall 4 of the tank C. Like reference numerals will be given to similar parts for the pivotal mounting of the side member 1 of the U-shaped handle A to the side wall 6 of the carriage D and to the side wall 3 of the water receiving tank C. It is possible to have the tubular frame A pivotally supported by the carriage D rather than by the sides of the tank C. If this were done, the carriage D could have supports, not shown, extending upwardly from the carriage and on which the frame A would be pivotally mounted.

It will be noted from FIGS. 1, 2, 5, 6 and 7 that the side members 1 and 2 of the U-shaped tubular frame A each has a tubular extension 1*a* and 2*a*, respectively, connected to and communicating with the hollow T, shown at 9. The outer ends of the hollow extensions 1*a* and 2*a* are connected to and rotatably support a drum G. A detail showing of the mounting of the extension 2*a* to the drum G is shown in the enlarged sectional view of FIG. 4. The extension 2*a* for the U-shaped frame A has an elbow 12 connected to its outer end and the elbow in turn communicates with a cylindrical stub pipe 13. This pipe 13 constitutes the supporting axle for the drum G and is connected to the end 14 of the drum by a standard bearing and housing assembly indicated generally at 15.

Figure 4:
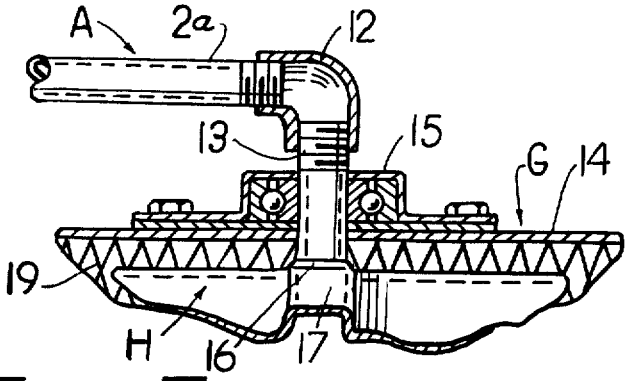
FIG. 4 is an enlarged sectional view along the line 4—4 of FIG. 3 and shows the bearing support for one end of the cylindrical drum and its rotatable connection with the frame of the machine. Both ends of the drum are supported in this manner.

Still referring to FIG. 4, it will be seen that the stub cylindrical pipe 13 does not rotate but the bearing 15 permits the drum end wall 14 to rotate about the pipe 13. This is important because the inner end of each of the two cylindrical stub pipes 13 is welded at 16 to the ends of a piece of tubing 17 that is square in cross section, see also FIGS. 5 and 6. In these last named FIGS., the tubing 17 is shown with its bottom wall lying in a horizontal plane and the upper horizontal wall of the tubing is provided with an elongated slot 18, see FIG. 6, or with a plurality of openings, not shown in the drawings.

Since the tubing 17 is prevented from rotating and inasmuch as it is square in cross section and its upper wall lies in a horizontal plane, it is readily understood that this tube 17 will provide a non-rotatable support for a water receiving tray, indicated generally at H and shown in vertical cross section in FIG. 5. The tray H is received within the interior of the cylindrical drum G and its length is substantially coextensive with the inner length of the drum between the end walls 14. The tray H may be welded or removably mounted on the tube 17.

I will now describe the drum G in more detail. FIGS. 1, 2, 5 and 6 show that the cylindrical portion 19 of the drum is perforated and as one form of perforated cylinder, it may be made from expanded metal. On the outer surface of this cylindrical perforated part of the drum G, I mount a layer of sponge J or other water absorbing and compressible material. If desired, each edge of the sponge layer G may abut a tire K that encircles the drum and whose cross sectional thickness is such that the tire does not project beyond the outer cylindrical surface of the sponge layer J. This arrangement will permit the sponge to be progressively compressed by coming into contact with the surface 20 as the device is moved over the surface as will be described later. The weight of the drum G will cause it to contact the surface 20 and the frame A will pivot about the common axes of the bushings 11, shown in FIGS. 6 and 7, to permit this swinging movement of the frame. It is possible for the operator to raise the drum G above the surface 20 by pressing downwardly on the handle B and swinging the frame A in a counterclockwise direction about the two aligned bushings 11, which constitute the pivotal axis for the frame. The double dot dash lines for the frame A and drum G indicate this movement.

Figure 3:
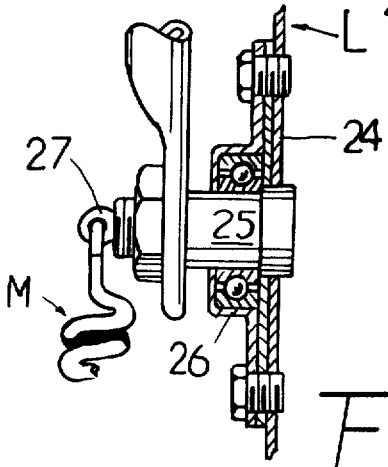
FIG. 3 is an enlarged sectional view of the bearing support for one end of the spring biased roller and is taken along the line 3—3 of FIG. 2. The pivoted arm that connects the roller to the frame has been rotated 90° from its position shown in FIG. 2 so that it can be shown in FIG. 3.

Before describing the operation of the device, I will set forth the novel means for progressively compressing the sponge layer J for squeezing out any water that the sponge picks up as it is rolled over the wet surface 20. In FIGS. 1, 2 and 3, I show a spring biased wringer roller, indicated generally at L. This roller is rotatably carried by two arms 21 that are pivotally connected at 22 to the upper ends of a pair of uprights 23 that in turn have their lower ends welded or otherwise secured to the extensions 1*a* and 2*a* of the frame A.

The enlarged sectional view of FIG. 3 illustrates how one of the swingable arms 21 is connected to the adjacent end 24 of the roller L. The free end of the arm 21 is secured to a stub shaft 25 and a standard bearing and housing assembly 26 encloses the stub shaft and in turn is secured to the end wall 24 of the roller. The two stub shafts 25 for the roller L are in axial alignment with each other and the uprights 23 and the swingable arms 21 will position the roller L above the drum G, so that the roller will contact the adjacent portion of the sponge layer J.

I provide novel adjustable means for yieldingly holding the roller L in contact with the adjacent portion of the layer of sponge J. In FIGS. 2 and 3, I show a tension spring M connected to the outer end of the stub shaft 25 and also adjustably connected to the outer end of the extension 2*a* of the frame A. I do not wish to be limited to the precise detail of attachment shown because this illustration is given as one example. The stub shaft 25 of FIG. 3 has an eyelet 27 at its outer end and the upper end of the spring M is connected to the eyelet.

The lower end of the spring M, see FIG. 2, is connected to an eyelet 28 that has an integral collar 29, which is slidably mounted on a threaded shank 30 of a bolt whose head 31 is an eyelet that is received in another eyelet 32, the latter eyelet being integral with the elbow on the extension 2*a*. A nut 33 is mounted on the threaded portion of the bolt 30 and may be adjusted on the bolt for moving the collar 29 and eyelet 28 for creating the desired tension on the spring M. I have described the adjustable spring connection between the arm 21 and the extension 2*a* on the frame A so as to yieldingly urge the adjacent end of the roller L against the layer of sponge J for compressing it and squeezing out any water in the sponge. The same adjustable spring connection is made between the arm 21 on the opposite end of the roller L and the extension 1a of the frame A. There is no need to describe this in detail.

OPERATION

From the foregoing description of the various parts of the device, the operation thereof may be readily understood. The water receiving tank C has a stopper 34, see FIGS. 1, 5 and 6, that normally closes an outlet opening 35 in the tank bottom. A chain 36 may be secured to the stopper and its other end connected to the tank wall.

In using my device, the operator adjusts the tension on the springs M for causing the roller L to exert the desired pressure on the adjacent portion of the sponge layer J for compressing it and squeezing out any water in that part of the sponge. FIG. 1 shows that the length of the roller L is coextensive with the width of the layer of sponge. In other words, the roller lies between the two tires K mounted on the drum G. Also, the roller is positioned above the water receiving tray H, see FIG. 5, so that any water squeezed out of the sponge J by the roller L will flow by gravity through the perforated cylindrical wall 19 of the drum and drop into the tray H.

It has already been explained that the operator moves the device over the wet surface 20 which is to be dried, such as a tennis court, and the drum G will roll over the surface and the weight of the drum will momentarily compress that portion of the sponge layer J contacting the wet surface 20 so that as soon as the weight of the drum on the sponge is released, the subsequent and progressive enlarging of the sponge portion back to its normal thickness will cause the sponge to pick up any water on the surface. The continued rolling of the drum will bring the water loaded portion of the sponge into contact with the roller L and the spring tension on the roller plus its own weight is sufficient to squeeze out the water from the compressed portion of the sponge and this water will pass through the perforated cylinder of the drum G and drop into the tray H.

From the tray H the water will gravitate into the horizontal tubing 17 through the slot 18. FIG. 6 shows the tubing 17 and the water flow into the tubular extensions 1*a* and 2*a* of the frame A is shown by the arrows 37. The tubular extension 1*a*, see FIG. 5, is inclined downwardly when the frame A is in normal position and the water will therefore flow into the elbow 12 from the tubing 17 and thus flow along the extension 1*a* until it reaches the T 9, at which point the water is deflected into the stem portion 10 of the T and into the tank C, because the adjacent end of the side 1 is closed, which is not shown in FIG. 6. However, FIGS. 6 and 7 do show the extension 2*a* connected to its T 9 and further show the adjacent end 38 of the frame side 2 closed so that water cannot enter it. Both sides 1 and 2 are similar in structure.

In this way the movement of the device over the wet surface 20 will transfer the water from the surface and into the tank C, as shown in FIGS. 5, 6 and 7. When the operator wishes to make a turn with his machine or to lift the drum G above the surface 20, he presses downwardly on the handle B and this will swing the frame A about its pivots, which are the bushings 11 and the drum will be lifted above the surface. The operator can make a quick turn with the machine when the drum is in raised position because the caster wheels F can readily swing about their vertical axes to permit a short quick turn. When the tank C receives sufficient water, the device can be moved over to a sewer outlet, not shown, and the stopper 34 lifted from the outlet 35 in the tank to permit the water to drain from the tank, after which the stopper is again applied to close the outlet.

I claim:

1. A device of the type described, comprising:

a. a carriage movable over a wet surface that is to be dried and including supports for a frame;

b. a frame associated with said carriage and having side members pivotally connected to said supports;

c. a drum rotatably carried between said side members and having a perforated cylindrical wall covered by a layer of water absorbing compressible material that normally rolls over the wet surface as the device is moved for absorbing and removing any water on the surface;

d. a wringer roller substantially coextensive in length with the length of said drum and means for causing said roller to bear against the water absorbing material along a line lying in a diametrical plane of the drum that also extends through the portion of said material contacting with the wet surface, whereby any water picked up by the material as it contacts the surface will be squeezed out by said roller and will drop by gravity into the drum interior by passing through the perforated cylindrical wall;

e. a water receiving tray mounted within said drum for catching the water squeezed from said material, said tray being supported to prevent its rotation within said drum;

f. the side members of said frame having said drum disposed on one side of the pivot for said frame;

g. the side members of said frame having a handle disposed on the opposite side of the pivot for said frame;

h. whereby the handle may be swung downwardly for causing said frame side members to swing about their pivots and to lift the drum above the surface over which the carriage moves;

i. the carriage being provided with caster wheels that permit the ready turning of the carriage and raised drum in a small radius if desired.

2. A device of the type described, comprising:

a. a carriage movable over a wet surface that is to be dried and including supports for a frame;

b. a frame associated with said carriage and having side members pivotally connected to said supports;

c. a drum rotatably carried between said side members and having a perforated cylindrical wall covered by a layer of water absorbing compressible material that normally rolls over the wet surface as the device is moved for absorbing and removing any water on the surface;

d. a wringer roller substantially coextensive in length with the length of said drum and means for causing said roller to bear against the water absorbing material along a line lying in a diametrical plane of the drum that also extends through the portion of said material contacting with the wet surface, whereby any water picked up by the material as it contacts the surface will be squeezed out by said roller and will drop by gravity into the drum interior by passing through the perforated cylindrical wall;

e. a water receiving tray mounted with said drum for catching the water squeezed from said material, said tray being supported to prevent its rotation within said drum;

f. a water receiving tank supported by said carriage; and g. means for conveying any water received in said tray to said tank, the tank having a water outlet normally closed by a removable plug;

h. the means for conveying the water from the tray to the tank includes portions of the side members of said frame being hollow and the pivot points for the frame including hollow tees having portions entering the sides of the tank, the portions of said side members that extend from the drum to the tees being inclined downwardly when the drum contacts the surface so that any water in the tray will flow by gravity to the tank.

* * * * *